US009915108B1

(12) United States Patent
Keast

(10) Patent No.: US 9,915,108 B1
(45) Date of Patent: Mar. 13, 2018

(54) DUAL CONTROL HYDRAULIC CIRCUIT FOR A TILTING POWER SWIVEL

(71) Applicant: Larry G. Keast, Houston, TX (US)

(72) Inventor: Larry G. Keast, Houston, TX (US)

( * ) Notice: Subject to any disclaimer, the term of this patent is extended or adjusted under 35 U.S.C. 154(b) by 221 days.

(21) Appl. No.: 15/084,349

(22) Filed: Mar. 29, 2016

Related U.S. Application Data

(60) Provisional application No. 62/142,990, filed on Apr. 3, 2015.

(51) Int. Cl.

| | |
|---|---|
| ***E21B 19/06*** | (2006.01) |
| ***F15B 11/17*** | (2006.01) |
| ***F15B 15/14*** | (2006.01) |
| ***F15B 15/20*** | (2006.01) |

(52) U.S. Cl.
CPC ..... *E21B 19/06* (2013.01); *F15B 11/17* (2013.01); *F15B 15/1428* (2013.01); *F15B 15/20* (2013.01); *F15B 2211/20592* (2013.01); *F15B 2211/252* (2013.01)

(58) Field of Classification Search
CPC .... F15B 2211/20592; F15B 2211/7051; F15B 2211/7058; E21B 3/02; E21B 19/06
USPC ..... 166/75.11, 77.1; 175/85
See application file for complete search history.

(56) References Cited

U.S. PATENT DOCUMENTS 2,960,311 A 11/1960 Scott
3,766,991 A * 10/1973 Brown ..... E21B 3/02 173/164
3,780,883 A * 12/1973 Brown ..... E21B 19/15 175/85
4,890,681 A * 1/1990 Skelly ..... E21B 3/02 173/218
5,794,723 A 8/1998 Caneer, Jr. et al.
7,076,947 B2 * 7/2006 Ariga ..... E02F 9/2232 60/452
7,090,035 B2 8/2006 Lesko
8,807,207 B1 * 8/2014 Keast ..... E21B 19/06 166/77.1
8,807,208 B1 * 8/2014 Keast ..... E21B 19/06 166/75.11
2006/0011350 A1 1/2006 Wiggins et al.
2013/0011221 A1 1/2013 Mcintosh et al.

* cited by examiner

*Primary Examiner* — Thomas E Lazo
(74) *Attorney, Agent, or Firm* — Buskop Law Group, P.C.; Wendy Buskop

(57) ABSTRACT

A dual control hydraulic circuit for a tilting power swivel having a main hydraulic pump providing an operational supply of hydraulic fluid causing a clockwise or counter clockwise rotation of the tilting power swivel. A hydraulic cylinder used to hydraulically power an angular change between a bail and a body, wherein a local control valve can enable extension and retraction of a rod of the hydraulic cylinder. An auxiliary hydraulic pump providing hydraulic fluid at a low pressure, a hydraulic reservoir fluidly connected to the main hydraulic pump and the auxiliary hydraulic pump, an engine connected to the main hydraulic pump, and a hydraulic fluid return line from a local control valve to the hydraulic reservoir used for dual control for operating the hydraulic cylinder to tilt the tilting power swivel and a remote control connected to the local control valve for controlling the local control valve.

6 Claims, 2 Drawing Sheets

DUAL CONTROL HYDRAULIC CIRCUIT FOR A TILTING POWER SWIVEL

CROSS REFERENCE TO RELATED APPLICATION

The current application claims priority to and the benefit of U.S. Provisional Patent Application Ser. No. 62/142,990 filed on Apr. 3, 2015, entitled "DUAL CONTROL HYDRAULIC CIRCUIT FOR A TILTING POWER SWIVEL". This reference is incorporated in its entirety herein.

FIELD

The current embodiments generally relate to a dual control hydraulic circuit for a tilting power swivel.

BACKGROUND

A need exists for a simple hydraulic circuit for a tilting power swivel, which can have dual controls for use in installing or removing a tilting power swivel to or from a derrick to a carrying rack or power swivel support rack on a trailer or skid hydraulic power unit.

The present embodiments meet these needs.

BRIEF DESCRIPTION OF THE DRAWINGS

The detailed description will be better understood in conjunction with the accompanying drawings as follows.

Figure 1:
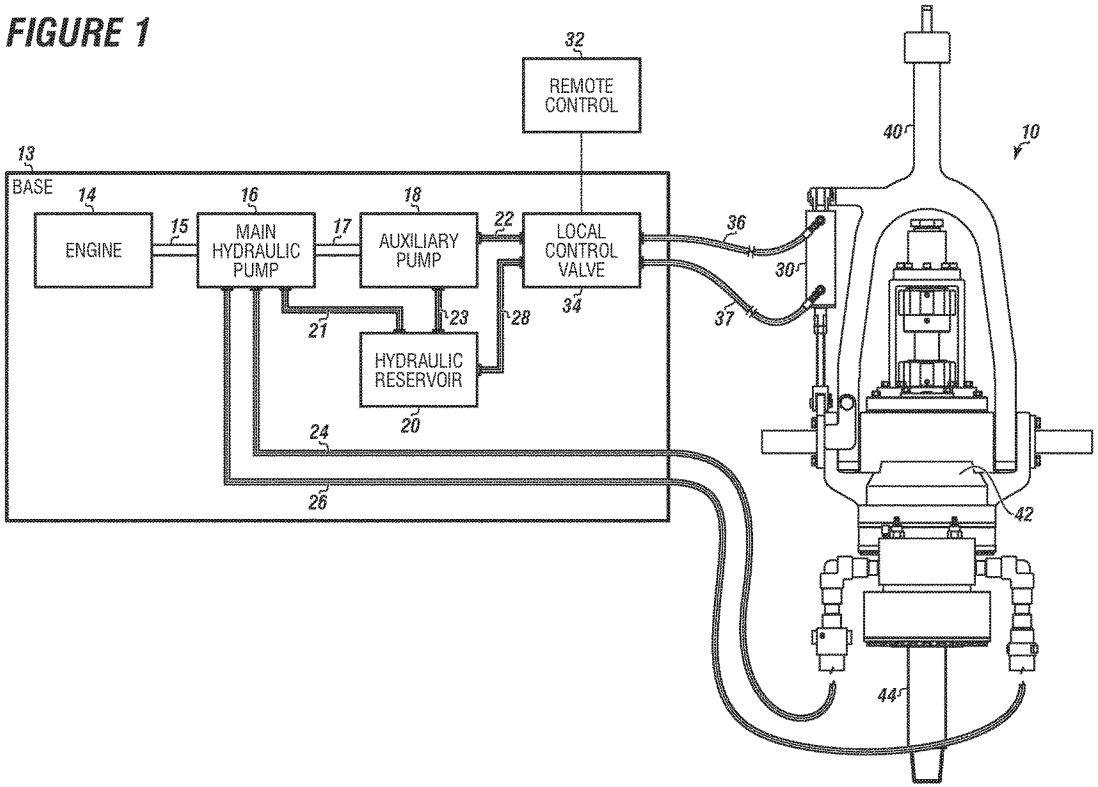
FIG. 1 depicts a diagram of a hydraulic circuit for a tilting power swivel according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The current embodiments generally relate to a dual control hydraulic circuit for a tilting power swivel.

The present invention of a dual control hydraulic circuit for a tilting power swivel has a remote control, which eliminates the need for human handling of the tilting power swivel during threading into the next joint of pipe.

The resulting benefits are improved safety and speed by allowing easy alignment of a tilting power swivel quill with the next joint of pipe to be raised, which can be lying at an angle in a V-door or on a catwalk.

Further benefits result from the use of a local control valve on a power swivel support rack to allow picking up or laying down the lifting bail hydraulically to facilitate improved safety and speed when removing or replacing the tilting power swivel in the support rack. Therefore, human handling of the heavy bail is eliminated.

Also, the local control valve can serve as a backup if the remote control fails.

The unique hydraulic circuit can use only one additional long hose for a total of four long hoses, which can enable the system to use a simple four-hose reel.

This extra hose can receive fluid from an auxiliary pump to extend a hydraulic cylinder and tilt the tilting power swivel to a preset angle. Retracting the hydraulic cylinder and returning the tilting power swivel to a vertical orientation does not require an additional long hose because an existing source of hydraulic fluid can be taken from the main power lines of the tilting power swivel using special valving.

The embodiments further relate to a dual control hydraulic circuit for a tilting power swivel having an engine-driven main hydraulic pump that can provide hydraulic fluid causing clockwise or counter-clockwise rotation of the tilting power swivel.

An auxiliary pump can be mechanically connected to the main hydraulic pump to provide a separate flow of hydraulic fluid through a fourth long hose to a hydraulic cylinder connected to the tilting power swivel for tilting the tilting power swivel to an angle position.

A hydraulic reservoir can be fluidly connected to the main hydraulic pump, the auxiliary pump, and the tilting power swivel.

An additional short hose or plumbing can run from the tilting power swivel to the hydraulic cylinder and provide low pressure hydraulic fluid to the hydraulic cylinder to assist gravity in tilting the tilting power swivel from an angle position to a vertical position.

The hydraulic cylinder can be used to tilt the tilting power swivel by receiving the low pressure hydraulic fluid from the auxiliary pump, which can be 1500 psi and the low pressure hydraulic fluid from the tilting power swivel, which can be 300 psi.

A remote control can be pneumatically, hydraulically, or electronically connected to a local control valve to allow safe tilting of the tilting power swivel while loading or unloading from the tilting power swivel transportation rack.

In embodiments, the hydraulic cylinder can require two hoses, one for extending and one for retracting a rod into the hydraulic cylinder. One hose can be used for extension of the rod and tilting of the tilting power swivel, can be the only additional long hose run from the auxiliary pump. However, the second hose for retraction of the rod into the hydraulic cylinder can be a short hose connected to existing low pressure in the tilting power swivel used to retract the rod.

Alternatively, a spring or other biasing means can be used to pull the tilting power swivel back to a vertical position, still resulting in a four hose requirement.

The tilt cylinder assembly can be powered in part by hydraulic fluid from the power swivel, and powered in part from a separate hydraulic fluid line connected to the tilt cylinder assembly. This novel arrangement allows for the operation of the tilt function with the addition of only one hydraulic hose to existing equipment, resulting in cost savings and allowing all required hoses to be rolled up on a single hose reel.

The term "hose," "four hose," or "four-hose reel" as used herein can refer to any fluid conduit used for supplying hydraulic fluids or other fluids.

In embodiments, a separate hydraulic fluid line can pass through a four hose assembly. A commonly used hydraulic hose reel assembly for a power swivel has three hoses including two hydraulic supply hoses and a drain hose.

The present invention can add a tilt function to the power swivel with the addition of a fourth hose assembly, which can be accomplished with minimal modification to the hydraulic hose reel assembly and the power swivel.

The term "auxiliary hydraulic pump" as used herein can refer to a hydraulic pump mounted to the main hydraulic pump. The auxiliary hydraulic pump can be a hydraulic pump that is driven by the main hydraulic pump. The auxiliary hydraulic pump provides power for all hydraulic functions of the power swivel except rotation of the power swivel.

The term "dual control" as used herein can refer to the alternate tilting operation of the power swivel by a local control valve positioned on the power unit of the tilting power swivel or a remotely located pneumatic, hydraulic or electric control that remotely operates the local control valve.

The term "engine" as used herein can refer to an engine that is either an electric motor or a combustion engine having horsepower in the range from 100 horsepower to 600 horsepower. In embodiments, the engine can be used to drive the main hydraulic pump mounted to the engine. In embodiments, the engine can be mounted to a trailer or a skid.

The term "hydraulic circuit" as used herein can refer to a fluid power circuit that provides both power and control of the power swivel for rotation, tilt, engine throttle, engine kill, emergency engine kill, torque release, maximum torque control, and other functions.

The term "hydraulic cylinder" as used herein can refer to a hydraulic cylinder with a threaded cylinder rod. In embodiments, the threaded cylinder rod can be used for adjusting the length of the threaded rod extending from the cylinder to set the maximum tilt angle. In embodiments, the hydraulic cylinder can be used for tilting.

The term "hydraulic reservoir" as used herein can refer to a tank or container that holds the hydraulic fluid used by both the main hydraulic pump and the auxiliary pump. The hydraulic reservoir can be mounted to the skid or trailer of the tilting power swivel. The hydraulic fluids can include hydraulic oil, such as petroleum based hydraulic oil.

The term "local control valve" as used herein can refer to a valve that controls a flow into a hydraulic cylinder either operated by hand of a user or by a pneumatic, hydraulic or electric operator of hydraulic fluid. In embodiments, a usable local control valve can be a four way valve with ½ inch ports, operating at 10 gallons per minute with a 2000 psi maximum working pressure.

The term "low pressure" for the phrase low pressure hydraulic fluid as used herein can refer to a pressure range from 1 psi to 3000 psi.

The term "main hydraulic pump" as used herein can refer to a pump that provides fluid from the hydraulic circuit to provide rotational power to the power swivel. The rotation can be clockwise and counterclockwise.

The term "remote control" as used herein can refer to a controller that can be a valve or another device that controls a flow from the local control valve. The remote control is a remote operator of the local control valve. In embodiments, the remote control can be a computer for electronic control. In embodiments, the remote control can be a hydraulic, pneumatic, or electric controller.

The term "tilting power swivel" as used herein can refer to a power swivel with tilt system and power swivel with tilt.

The term "support rack" as used herein can refer to a structure mounted on a trailer or skid that supports the power swivel for transporting to a rig site. In embodiments, the support rack can be referred to as a swivel rack. In embodiments, the support rack can be a base.

In an embodiment, the dual control hydraulic circuit for a tilting power swivel can have a main hydraulic pump connected to the tilting power swivel for rotation. The main hydraulic pump can provide an operational supply of hydraulic fluid causing a clockwise or counter clockwise rotation of the tilting power swivel. Also, the main hydraulic pump can operate at a pressure range from 300 psi to 5000 psi.

The dual control hydraulic circuit for a tilting power swivel can have a hydraulic cylinder mechanically connected to the tilting power swivel to hydraulically power an angular change between a bail and a body. In embodiments, the angular change can range from 0 degrees to 90 degrees allowing insertion of the quill into a pipe or tubular lying at an angle.

In embodiments, the dual control hydraulic circuit for a tilting power swivel can have a local control valve mounted on the support rack or base connected to the hydraulic cylinder to enable extension and retraction of the rod of the hydraulic cylinder by operation of the local control valve. An auxiliary hydraulic pump can be connected to the local control valve for providing hydraulic fluid at a low pressure.

In embodiments, the dual control hydraulic circuit for a tilting power swivel can have a hydraulic reservoir fluidly connected to the main hydraulic pump and the auxiliary hydraulic pump. An engine can be connected to the main hydraulic pump by an engine shaft. Also, the dual control hydraulic circuit for a tilting power swivel can have a hydraulic fluid return line from the local control valve of the tilting power swivel to the hydraulic reservoir.

In embodiments, the dual control hydraulic circuit for a tilting power swivel can have a remote control connected to the local control valve for remotely controlling the local control valve.

Figure 2:
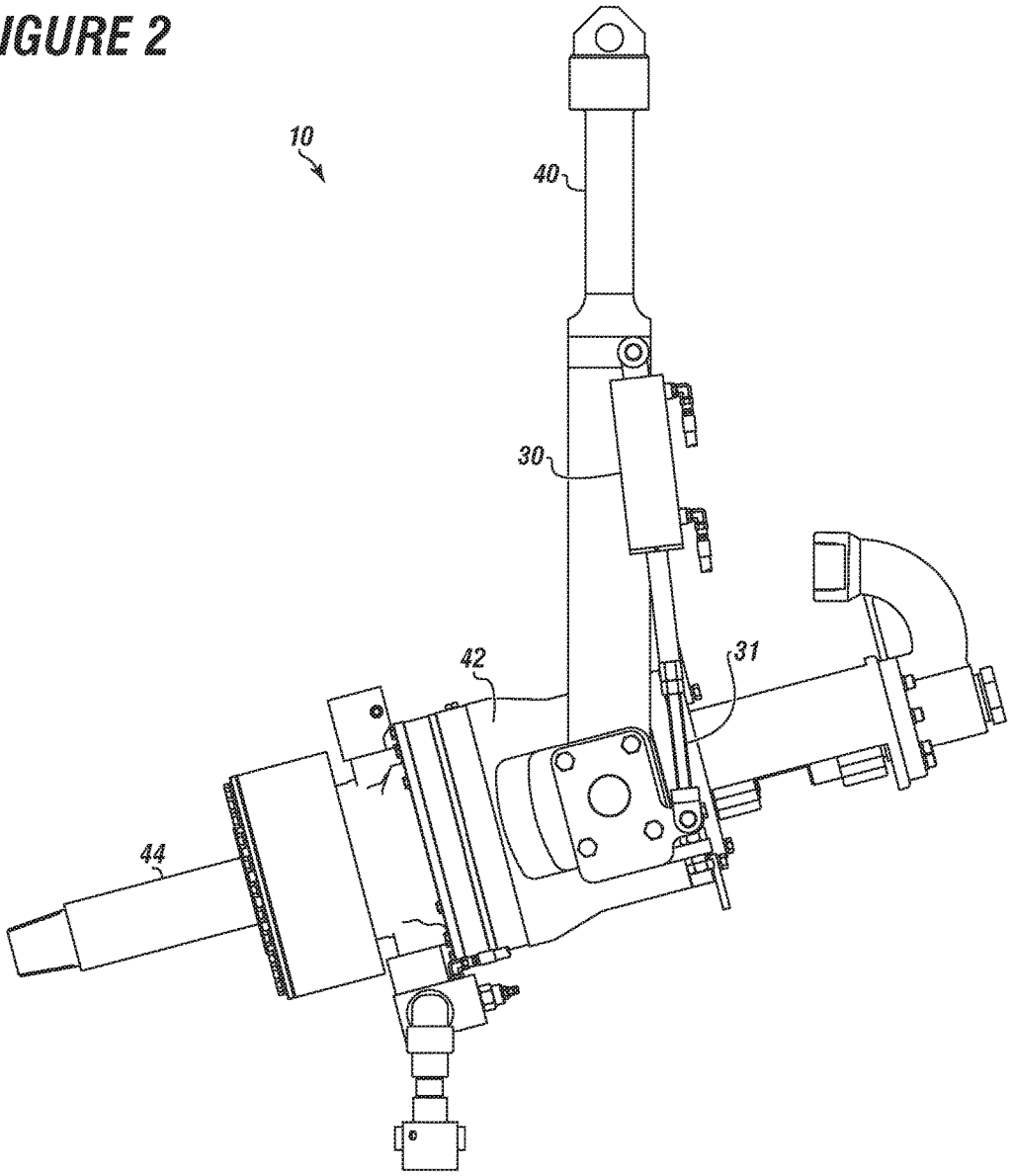
FIG. 2 depicts the tilting power swivel according to one or more embodiments.

Turning now to the Figures, FIG. 1 depicts a diagram of a hydraulic circuit for a tilting power swivel according to one or more embodiments. FIG. 2 depicts the tilting power swivel according to one or more embodiments.

The tilting power swivel 10 can be mounted to a base 13 for transport and then positioned in a derrick for operation. The base 13 can be movable, such as a trailer on wheels with brakes that can be pulled by a truck, a self-powered unit, or a skid.

In embodiments, the tilting power swivel can include a bail 40 connected to a body 42.

The tilting power swivel 10 can be in fluid communication with a hydraulic cylinder. 30.

In embodiments, an engine 14 can be mounted to the base 13. The engine 14 can be mechanically connected to a main hydraulic pump 16. The main hydraulic pump 16 can provide an operational supply of hydraulic fluid 21 to the tilting power swivel 10 to rotate a tilting power swivel quill 44 clockwise and counter clockwise.

In embodiments, the mechanical connection can have a shaft 15 connecting the engine 14 and the main hydraulic pump 16. The main hydraulic pump 16 can be mechanically connected in line to auxiliary pump 18. Further, a pump shaft 17 can connect the main hydraulic pump 16 with the auxiliary pump 18. The auxiliary pump 18 can supply low pressure hydraulic fluid 22 to a local control valve 34.

In embodiments, a hydraulic reservoir 20 can supply hydraulic fluid 21 to the main hydraulic pump 16. The hydraulic reservoir 20 can receive hydraulic fluid 21 from the local control valve 34 via a hydraulic fluid return line 28.

The local control valve 34 can not only receive low pressure hydraulic fluid 22 and transmit low pressure hydraulic fluid 22 to the hydraulic reservoir, but also can provide hydraulic fluid through a hydraulic control line 36 to the hydraulic cylinder 30, which can be mounted on the tilting power swivel to extend or allow retraction of a threaded rod 31 of the hydraulic cylinder 30. The hydraulic cylinder can hydraulically power an angular change between the bail 40 and the body 42. The angular change can range from 0 degrees to 90 degrees. In embodiments, the local control valve 34 can receive return hydraulic fluid 37 from the hydraulic cylinder 30 of the tilting power swivel 10.

In embodiments, the bail 40 of the tilting power swivel can be hinged to the body 42 of the tilting power swivel 10. The bail 40 can be angularly adjustable from a vertical orientation to an angled position using the dual control hydraulic circuit.

In embodiments, the angular change is a controlled power tilting of the tilting power swivel 10 that enables angular alignment with a threaded pipe laying at an angle in a V-door or catwalk.

In embodiments, the low pressure hydraulic fluid 22 can retract the rod 31 of the hydraulic cylinder 30 from an extended or tilted position, causing the tilting power swivel 10 to return to a vertical orientation in a support rack. The extension or retraction of the rod can be 50 percent the length of the rod.

In embodiments, the auxiliary pump 18 can receive an additional hydraulic fluid 23 from the hydraulic reservoir 20.

A remote control 32 can be in communication with the local control valve 34, which can provide a dual control operation of the hydraulic cylinder 30. The remote control can be pneumatic, electronic, or hydraulic in operation. In embodiments, the remote control can be a cellular phone, a laptop, a tablet computer, or a similar processing device with data storage and bidirectional communication.

The remote control 32 can be mounted in a portable control panel, which can be detached from the base 13. In embodiments, the remote control 32 can be used for aligning joints of pipe laying in the V-door or the catwalk for safety, speed, and convenience.

In embodiments, the local control valve 34 can communicate with the remote control 32, which can pneumatically or hydraulically operate the local control valve 34, for remote control of the tilting power swivel 10. The local control valve 34 can be mounted on the base 13 or a support rack for operating the hydraulic cylinder 30 tilting the tilting power swivel 10 while loading and unloading.

In embodiments, a four hose reel can be used to provide a first operational supply of hydraulic fluid 24 and a second operational supply of hydraulic fluid 26 to the body 42 of the tilting power swivel 10 for rotation.

While these embodiments have been described with emphasis on the embodiments, it should be understood that within the scope of the appended claims, the embodiments might be practiced other than as specifically described herein.

What is claimed is:

1. A dual control hydraulic circuit for a tilting power swivel comprising:

a. a main hydraulic pump connecting to the tilting power swivel for rotation, the main hydraulic pump providing an operational supply of hydraulic fluid causing a clockwise or counter clockwise rotation of the tilting power swivel, the main hydraulic pump operating at a pressure range from 300 psi to 5000 psi;

b. a hydraulic cylinder mechanically connected to the tilting power swivel to hydraulically power an angular change between a bail and a body, wherein the angular change ranges from 0 degrees to 90 degrees;

c. a local control valve connected to the hydraulic cylinder to enable extension and retraction of a rod the hydraulic cylinder;

d. an auxiliary hydraulic pump connected to the local control valve for providing a hydraulic fluid at a low pressure;

e. a hydraulic reservoir fluidly connected to the main hydraulic pump and the auxiliary hydraulic pump;

f. an engine connected to the main hydraulic pump by a shaft;

g. a hydraulic fluid return line from the local control valve of the tilting power swivel to the hydraulic reservoir; and h. a remote control connected to the local control valve for controlling the local control valve.

2. The dual control hydraulic circuit for the tilting power swivel of claim 1, wherein the auxiliary pump is mechanically connected to the main hydraulic pump with a pump shaft.

3. The dual control hydraulic circuit for the tilting power swivel of claim 1, comprising a base that is a trailer or a skid.

4. The dual control hydraulic circuit for the tilting power swivel of claim 1, wherein the angular change is a controlled power tilting of the tilting power swivel that enables an angular alignment with a threaded pipe laying at an angle in a V-door or a catwalk.

5. The dual control hydraulic circuit for the tilting power swivel of claim 1, comprising the bail hingably connected to the body of the tilting power swivel, the bail being angularly adjustable from a vertical orientation to an angled position using the dual control hydraulic circuit.

6. The dual control hydraulic circuit for the tilting power swivel of claim 1, wherein the remote control is a pneumatic control, a hydraulic control or an electronic control.

* * * * *